United States Patent [19]

Schmermund

[11] 4,119,058

[45] Oct. 10, 1978

[54] GLUE APPLICATORS

[76] Inventor: Alfred Schmermund, Körnerstrasse 62, 5820 Gevelsberg, Fed. Rep. of Germany

[21] Appl. No. 771,489

[22] Filed: Feb. 24, 1977

[30] Foreign Application Priority Data

Mar. 11, 1976 [GB] United Kingdom ..... 9739/76

[51] Int. Cl.[2] ..... B05C 5/02

[52] U.S. Cl. ..... 118/411; 222/571

[58] Field of Search ..... 118/410, 411, 315, 412; 222/571, 485, 559; 141/117

[56] References Cited

U.S. PATENT DOCUMENTS

| | | | |
|---|---|---|---|
| 1,613,521 | 1/1927 | Martin | 118/411 X |
| 2,537,872 | 1/1951 | Wright | 222/559 X |
| 3,141,578 | 7/1964 | Quinn | 222/559 X |
| 3,298,353 | 1/1967 | Huffman | 118/411 |
| 3,332,580 | 7/1967 | Spencer et al. | 222/485 X |
| 3,603,286 | 9/1971 | Scopp et al. | 118/410 X |
| 3,892,339 | 7/1975 | Idler | 118/410 X |
| 3,965,860 | 6/1976 | Cone et al. | 222/485 X |

*Primary Examiner*—John P. McIntosh
*Attorney, Agent, or Firm*—Sughrue, Rothwell, Mion, Zinn and Macpeak

[57] ABSTRACT

There is disclosed a glue applicator which essentially consists of a housing provided with an applicator nozzle, with valve means, and with a passage to conduct glue to the nozzle, the valve means being interposed between the passage and the nozzle and comprising a valve slide slidable in a bore in the housing to control communication between the passage and the nozzle. By movement of an article past the nozzle, a glue coating in strip form can be applied to the article. The housing may also include means for storing, heating and pressure feeding the glue, and suction means connectable to the nozzle to suck glue back up the nozzle when the supply from the passage is interrupted by the valve slide. The applicator may have a number of such nozzles, controlled either by a single valve slide or by a number of such valve slides. Also disclosed is glue equipment comprising a glue applicator of the above-mentioned kind and a control system for controlling a supply of a pressure medium, such as compressed air, to pressure feed glue to the nozzle or nozzles of the applicator. Finally, there is disclosed gluing apparatus comprising the applicator in multi-valve form and actuating means firstly to actuate the valve slides of the applicator independently of each other and cyclically during operation of the apparatus, and secondly to actuate the valve slides to close all of the nozzles when the apparatus is stopped. The applicator can be arranged so that the part of its housing with the valve slides and nozzles can be uncoupled from the actuating means and removed from the rest of the apparatus.

36 Claims, 14 Drawing Figures

81a
84
62a
68
83a
63a
82a
81a
70
69
64a
71
77
76
81a
83a
63a
65
67
60
61
66
82a
80

GLUE APPLICATORS

BACKGROUND OF THE INVENTION

The present invention relates to a glue applicator, in particular for applying pressure fed glue in hot liquid form, and to gluing equipment and apparatus incorporating a glue applicator.

With existing kinds of glue applicators for the application of pressure fed glue onto moving articles, problems have arisen in achieving precision in the control of the output flow of the glue. These problems are of particular concern when high speed movement of the articles is desired, as the application of the glue coating to the articles must be interrupted between successive articles and in some cases during application to individual articles. In addition, the control of the glue flow is complicated by the viscous consistency of the glue itself, which requires additional attention to ensure that smearing does not occur.

It is difficult to achieve precise control simply by controlling the feed pressure of the glue, as relief of the pressure, which may for example be provided by compressed air, may not be able to be effected with sufficient abruptness to prevent glue from being applied to undesired locations on or between the articles during a pressure change. Greater precision in control of the glue flow is available from valve control of the feed itself, but the valves employed in existing applicators, for example needle and disc valves, are subject to encrustation by the glue with consequent impairment of their operating efficiency, and special designs of valves less liable to this problem tend to be correspondingly more expensive or difficult to manufacture.

The principal object of the invention is therefore the provision of a glue applicator with an improved valve control of the glue flow to allow accurate metering of applied quantities of glue.

A supplementary object of the invention is to provide an applicator of this kind with an efficient valve control which is of relatively uncomplicated construction and is economical to manufacture.

Another object of the invention is the provision of an applicator adapted to avoid spillage of residual glue quantities after the glue flow has been terminated by the valve control.

Yet another object of the invention is the provision of an applicator of a design lending itself to adaptation to different gluing formats, as in, for example, the application of patterns of glue strips to moving production-line articles.

Yet another object of the invention is the provision of gluing equipment combining such an applicator with a control system for supplying a pressure medium to pressure feed the glue, the system enabling control of the supply of the pressure medium in dependence on the operating condition and characteristics of the equipment.

A further object of the invention is the inclusion of such an applicator in gluing apparatus designed for intermittent high-speed operation, with the application of glue by the applicator being controllable to provide cyclically repeated gluing patterns and being able to be terminated when operation of the apparatus is stopped.

SUMMARY OF THE INVENTION

According to a first aspect of the present invention, there is provided a glue applicator comprising a housing provided with an applicator nozzle, with valve means, and with a passage to conduct glue to the nozzle, the valve means being interposed between the passage and the nozzle and comprising a bore in the housing and a valve slide slidable in said bore to control communication between the passage and the nozzle.

Preferably, the valve slide is provided with a conduit and a closure surface, which are so arranged that in a first position of the valve slide communication between the passage and the nozzle is provided by the conduit and in a second position of the valve slide the closure surface closes at least one of the passage and the nozzle. Conveniently, the conduit is provided by an annular groove in the valve slide, and the closure surface by a land adjacent the groove.

For preference, the valve slide is provided with stop means to define said first and second positions of the slide. Conveniently, the valve slide extends completely through the housing, and the stop means comprises two collars arranged one at each end of the slide externally of the housing to abut respective surfaces of the housing in the first position and the second position of the slide, respectively. The collars serve to arrest movement of the valve slide when passing from one position to the other position, the travel of the valve slide between the two positions being at least equal to the width of the nozzle or passage orifice to be closed.

The nozzle and the passage preferably extend substantially radially of the bore, and for preference are co-axial.

Expediently, the housing is provided with a chamber for the storage of glue to be supplied to the nozzle, and the passage communicates with the chamber. Access to the chamber to enable replenishing with glue is conveniently by way of a removable cover closing the chamber.

To enable pressure feeding of glue from the chamber to the nozzle, the housing may be provided with a duct for supplying the chamber with a suitable pressure medium, for example compressed air, and such duct may for convenience be located in the cover closing the chamber.

The housing is also preferably provided with heating means for heating glue contained in the applicator, and with a guide passage for the guidance of articles below the nozzle to receive strip coatings of glue therefrom, the guide passage expediently being so arranged that the direction of movement of articles guided therein is substantially at right angles to the axis of the bore containing the valve slide.

The housing may also be provided with a recess extending away from the nozzle and above a given path of a glue strip applied by the nozzle to an article guided in the guide passage, the recess being separated from the nozzle by a rim portion thereof.

To ensure that the glue flow from the nozzle is completely discontinued when the supply of glue thereto is terminated by the slide valve, the valve means may further comprise suction means so connectable to the nozzle in said second position of the valve slide as to suck any residual glue from the nozzle.

For this purpose, the valve slide is expediently provided with an interior cavity and with a channel which, in said second position of the valve slide, is so disposed as to communicate with the nozzle and the cavity, the cavity being defined by surfaces which, on movement of the valve slide into said second position, are relatively moved to so increase the volume of the cavity as to create a partial vacuum therein. By this means, any glue remaining in the nozzle after termination of the supply by the valve slide will be sucked up from the nozzle and into the channel by the partial vacuum. Conversely, on movement of the valve slide into said first position so as to restore the glue supply to the nozzle, the surfaces defining the cavity are relatively moved to so decrease the volume of the cavity as to create a pressure to expel glue from the channel back into the nozzle, where it is then immediately available for application by the nozzle. This arrangement will tend to prevent glue, which has been left in the nozzle after termination of the supply, from dripping onto the surface below the nozzle, and will promote more rapid onset of dispensing of glue from the nozzle when the supply is resumed.

In one convenient embodiment of an applicator incorporating suction means of this kind, the cavity is defined by a surface portion of an axial bore in the valve slide and by a surface portion of a member, which is engaged in such bore to be slidable relative to the valve slide and which is attached to the housing to be stationary relative thereto, so that under slidable movement of the valve slide the cavity-defining surface portions of the member and the axial bore in the valve slide are moved relative to each other to increase or decrease the volume of the cavity according to the direction of the movement of the valve slide. Preferably, the channel so communicates with the axial bore in the valve slide as to be opened by the member during movement of the valve slide into said first position and closed by the member during movement of the valve slide into said second position.

In place of a cavity of variable volume to provide the suction for residual glue in the nozzle, the valve slide may be provided with an interior duct, which is arranged to communicate with the nozzle in said second position of the valve slide and which is connectable to a source of suction, for example a vacuum pump.

To enable application of two or more parallel glue strips to articles, the applicator housing may be provided with a plurality of such nozzles and with a corresponding plurality of such passages respectively associated with the nozzles to conduct glue thereto. The supply of glue to the nozzle may be controlled as before by a single valve slide having a respective conduit and closure surface for each of the nozzles, and associated with each nozzle in applicators having a plurality of nozzles may, of course, be a respective recess extending away the associated nozzle and above a given path of a glue strip applied by that nozzle. Expediently, the nozzle supply passages communicate with a single glue storage chamber.

With the use of a single valve slide in such an applicator, parallel glue strips of substantially equal length can be applied to articles conveyed past the nozzles. If, however, it is desired to vary the lengths of individual ones of the glue strips, the applicator housing may be equipped with a plurality of such valve slides each slidable in a respective bore in the housing to control the supply of glue to at least one respective one of such nozzles, the nozzles being arranged at spacings to provide parallel glue strips. Expediently, the valve slides are independently actuable, so that by individual operation of the valve slides the glue supply to a nozzle associated with any one of the valve slides may be controlled to vary the length or continuity of the glue strip applied by that nozzle without affecting the length or continuity of the glue strip applied by the or each nozzle associated with the or each other valve slide. As before, it may be expedient if each of the valve slides is provided with a respective conduit and closure surface for the or each nozzle and passage associated with that valve slide.

In one example of such a multi-valve applicator, the applicator housing is provided with three such valve slides and with three pairs of nozzles controlled by the three valve slides, respectively. Expediently, the nozzles of each pair are arranged substantially symmetrically of a common transverse plane of the three valve slides, with the nozzles of a first one of the pairs being more widely spaced apart than the nozzles of a second one of the pairs, and the nozzles of the second pair being more widely spaced apart than the nozzles of the third pair. The articles can thus be provided with a first pair of glue strips of a length and continuity controlled by one of the valve slides, and with second and third pairs of glue strips parallel to the first pair and each of a length and continuity independently controlled by the respective other one of the valve slides. For preference, the valve slides are arranged in a common plane in the housing, and further such valve slides, also arranged in the same plane of the housing, can be added to enable further permutations of the number and relative locations of the nozzles.

The applicator can thus be constructed to suit a wide variety of gluing patterns, and the number of nozzles in operation in different gluing runs can be varied as desired by appropriate setting of the valve slides. Apart from being independently actuable, the valve slides may also be jointly actuable when variation of the lengths of individual glue strips is not required or when, for example, all the nozzles are to be closed simultaneously.

According to a second aspect of the present invention, there is provided gluing equipment comprising an applicator according to the first aspect of the invention, and a control system for controlling a supply of a pressure medium, for example compressed air, to pressure feed glue to the or each nozzle of the applicator. Such a control system preferably comprises a conduit, which is connectable to a source of the pressure medium and which is arranged to supply the pressure medium to the applicator, and a control valve, for example an electromagnetic valve, which is arranged in the conduit and which is adapted to open and close the conduit on, respectively, starting and stopping of a drive for the equipment.

The control system may further comprise a bypass duct connected to the conduit to bypass the control valve, and a bypass valve arranged in the by-pass duct and actuable to open the bypass duct when the drive is stationary. By this means, the pressure medium may be supplied to enable pressure feeding of the glue to the or each applicator nozzle when an alternative mode of operation of the equipment is desired, for example manual rather than automatic operation.

The bypass valve may comprise an electromagnetic valve, which is actuable to open the bypass duct by means of a manually operable switch. Expediently, the control system further comprises locking means to automatically lock the switch in a position in which the bypass duct is maintained in an open condition by the bypass valve, and advantageously the locking means is actuable to release the switch from said position on starting of the drive. The control system may also comprise means to prevent locking of the switch by the locking means when the equipment is being driven by the drive. Expediently, the locking means comprises a solenoid having a plunger engageable with the switch to lock the switch in said position, and the means for preventing such locking comprises a member engageable with the plunger to prevent engagement thereof with the switch.

The control system may further comprise a flow regulating valve arranged in the conduit to regulate the flow of the pressure medium in dependence on the operating speed of the equipment, the flow regulating valve preferably comprising a centrifugal valve driven by the drive for the equipment. For preference, the flow regulating valve is arranged in the conduit upstream of the control valve, while upstream of such regulating valve the conduit may incorporate a further, manually operable, regulating valve.

According to a third aspect of the present invention, there is provided gluing apparatus comprising a multivalve glue applicator according to the first aspect of the invention, and actuating means to actuate the valve slides of the applicator, the actuating means comprising first drive means to actuate the valve slides independently of each other and cyclically during operation of the apparatus, and second drive means to actuate the valve slides to close all the nozzles when operation of the apparatus is discontinued.

Expediently, the first drive means comprises a respective cam to actuate each of the valve slides through a respective rocker, and the cams may act on the rockers via rollers mounted on the rockers, the rollers preferably being maintained in engagement with the cams by resilient means acting on the rockers. In one convenient arrangement enabling actuation of the valve slides independently of each other, the cams are rigidly mounted on a common shaft and have respectively different profiles.

Preferably, the second drive means comprises a respective piston-cylinder unit coupled to each of the rockers, the piston-cylinder units being jointly actuable. Instead of piston-cylinder units, the second drive means may comprise other pressure fluid or electromagnetically actuated drives, and, if so desired, the second drive means may be operable to withdraw individual ones of the valve means from actuation by the first drive means.

Preferably, the applicator housing comprises an upper housing part and a lower housing part, the lower housing part being provided with the nozzles, passages and valve slides and being detachably mounted on the upper housing part. To this end, the upper housing part may be provided with a pair of clamping members which are each so engaged with a respective one of two opposite sides of the lower housing part as to clamp the lower housing part to the upper housing part. The applicator may be provided with a release mechanism operable to so relieve the clamping pressure applied by the clamping members as to enable removal of the lower housing part from the upper housing part, for example for cleaning or exchange.

The upper housing part is expediently provided with a glue storage chamber having outlet means for the supply of glue from the chamber to the passages in the lower housing part, and with a valve member actuable to close the outlet means, for example when removal of the lower housing part is desired.

Apart from a storage chamber in the applicator, the apparatus may also comprise a tank provided with a glue reservoir, which is closed by a removable lid and which has an outlet communicating with the glue storage chamber in the upper housing part, the upper housing part being mounted on the tank at a lower end thereof. To enable pressure feeding of glue from the reservoir to the glue storage chamber, the tank may be provided with a duct for the supply of a pressure medium, for example compressed air, to the reservoir. The duct preferably incorporates a valve which is so interlocked with closure means for retaining the reservoir lid in a closed position that the lid is removable only when the duct is closed by the valve.

To control the supply of the pressure medium to the reservoir, the apparatus may include a suitable control system, for example a control system of the kind incorporated in the equipment according to the second aspect of the invention.

For preference, the actuating means are coupled to the valve slides of the applicator, and the tank and applicator are displaceable relative to the actuating means to uncouple the actuating means from the valve slides.

BRIEF DESCRIPTION OF THE DRAWINGS

Embodiments of the present invention will now be more particularly described by way of example with reference to the accompanying drawings, in which.

DESCRIPTION OF THE PREFERRED EMBODIMENTS

Figure 1:
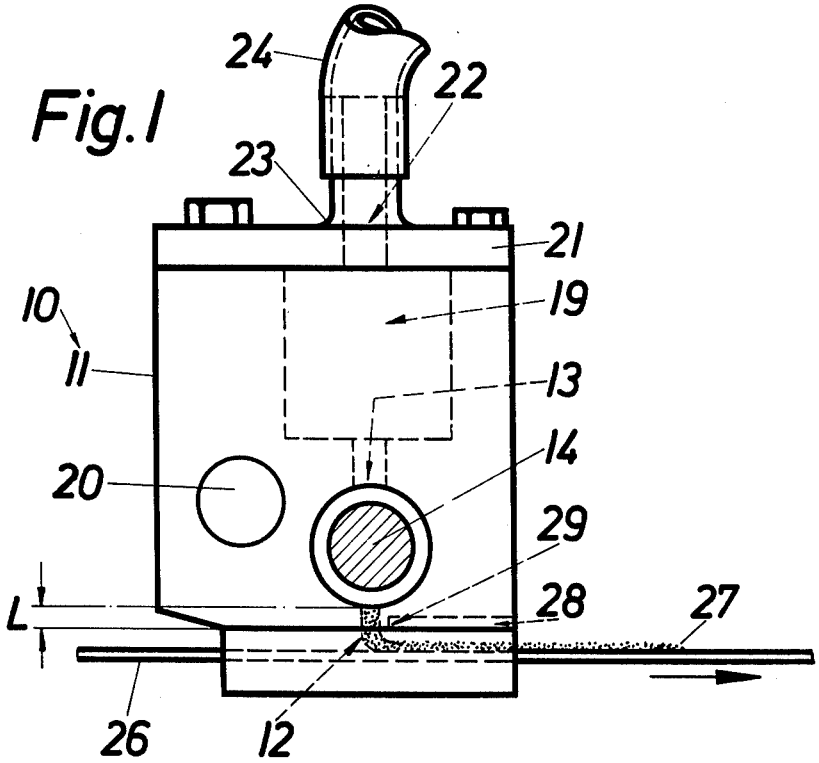
FIG. 1 is an end view of a glue applicator according to a first embodiment of the invention, the applicator having a single nozzle and valve.
Figure 2:
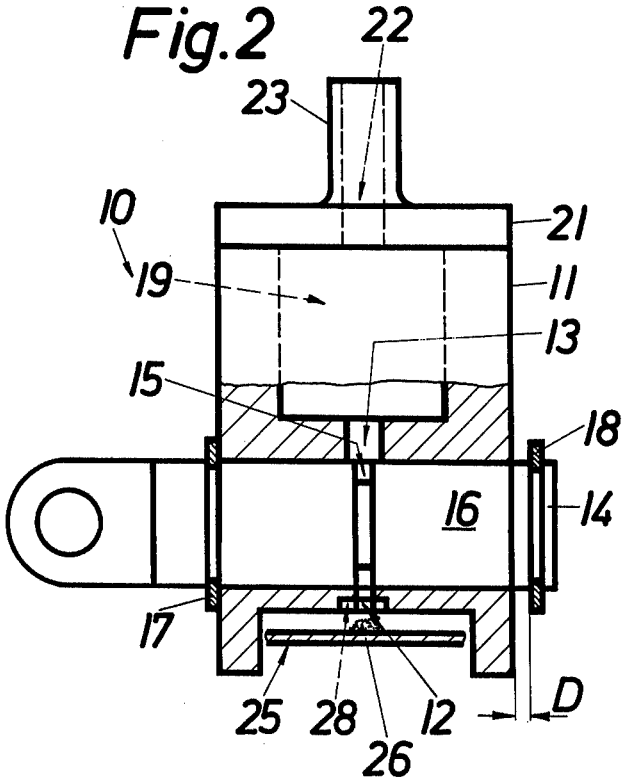
FIG. 2 is a partly sectioned side view of the applicator of FIG. 1.

Referring now to FIGS. 1 and 2 of the drawings, there is shown a glue applicator 10 comprising a housing 11 provided with a nozzle 12, a passage 13 to conduct glue to the nozzle, and valve means comprising a valve slide 14 slidable in a bore in the housing 11 to control the supply of glue from the passage to the nozzle. The slide 14 is provided with an annular groove 15 and an adjacent land 16, the valve slide being movable from a first position — shown in FIG. 2 — in which the nozzle 12 is in communication with the passage 13 via the annular groove 15, to a second position in which the land 16 closes the inlet orifice of the nozzle.

The first and second positions of the valve slide are defined by two collars 17 and 18, which are mounted on two end portions of the valve slide projecting out of the housing 11 and which abut adjacent surfaces of the housing when, respectively, the nozzles is opened by the valve slide and when the nozzle is closed by the valve slide. The travel of the valve slide between the first and second positions is thus represented by the distance D in FIG. 2, and this distance is not less than the diameter of the nozzle.

The projecting end portion of the valve slide provided with the collar 17 is formed with an extension having an aperture for the connection of actuating means to actuate the valve slide.

The nozzle 12 and passage 13 extend radially of the bore containing the valve slide 14, and are co-axial. The dimensions of the nozzle, in particular its length L shown in FIG. 1, are kept as small as possible so as to minimise the amount of glue that might remain in the nozzle when supply from the passage 14 is terminated by the valve slide 14. The diameter of the passage, however, is greater than the diameter of the nozzle, while the axial length of the groove 15 is substantially the same as the nozzle diameter.

The passage 14 communicates with the base of a chamber 19 provided in the housing for the storage of a quantity of a glue having a low viscosity, the glue being heated in the chamber and elsewhere in the applicator housing by a heating element 20. The chamber is closed by a housing cover 21, which can be removed to enable glue to be introduced into the chamber and which is provided with a duct 22 for the supply of compressed air to the chamber. The duct 22 extends through a stub pipe 23 projecting from the uppermost exterior surface of the cover, and communicates with a compressed air supply line 24 connected to the stub pipe.

Below the nozzle 12, the housing is provided with a guide passage 25 to guide movement past the nozzle of an article 26 to receive a strip 27 of glue from the nozzle, the strip being of substantially semicircular cross-section and the direction of movement of the article, as indicated by the arrow in FIG. 1, being perpendicular to the axis of the bore containing the valve slide 14. The housing is also provided in the uppermost surface of the guide passage with a recess 28, which extends away from the nozzle in the direction of movement of the article 26 and which is located above the glue strip 27 applied to the article. The recess is separated from the nozzle by a narrow rim portion 29, which serves to prevent the ingress of dirt and which facilitates severing of the glue strip 27 from the nozzle.

As will be apparent from the foregoing description, in operation of the applicator shown in FIGS. 1 and 2 compressed air is supplied via the air line 24 and duct 22 to the glue storage chamber 19, so as to force heated glue out of the chamber and into the passage 13. In the position of the valve slide 14 shown in FIG. 1, the glue is fed under pressure from the passage 13 to the nozzle 12 via the annular groove 15, and is applied by the nozzle to the upper surface of the article 26 so as to form — under movement of the article through the guide passage 25 — the glue strip 27, the article being moved by, for example, a conveyor. When it is desired to stop the glue flow from the nozzle, either to interrupt the continuity of the glue strip 27 on the article 26 or to completely terminate the strip, the valve slide 14 is moved through the distance D into the position in which its land 16 closes the inlet orifice of the nozzle.

On reverse movement of the valve slide, the glue flow from the nozzle is restored for application of a further portion of the glue strip 27 to the article 26, or for application of a similar glue strip to a further article.

The thickness of the glue strip 27 applied to the article 26 may be increased or decreased by decreasing or increasing, respectively, the speed of movement of the article past the nozzle, or by increasing or decreasing the pressure of the compressed air supplied to the chamber 19. The supply of such compressed air should be discontinued when the nozzles are closed and movement of articles past the nozzles is halted.

Figure 3:
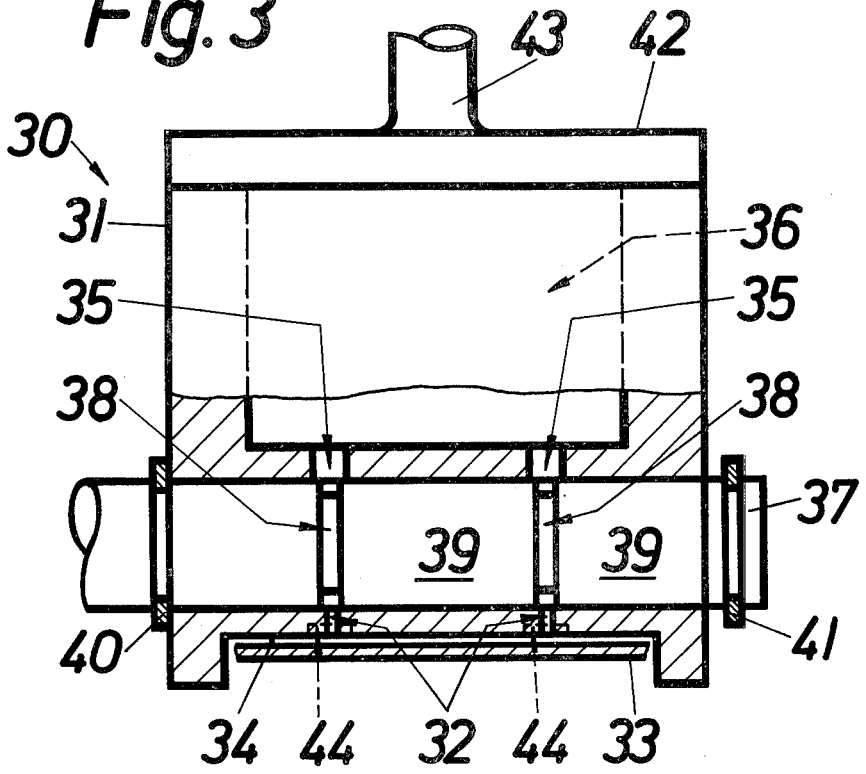
FIG. 3 is a partly sectioned side view of a glue applicator according to a second embodiment of the invention, the applicator having two nozzles controlled by a single valve.

In FIG. 3 there is shown an applicator 30 which is generally similar to the applicator 10 but which, by contrast, has a housing 31 provided with two nozzles 32 arranged at a desired spacing from each other to apply two separate glue strips to an article 33 moved through a guide passage 34 in the base of the housing. Glue is supplied to each of the nozzles 32 from a respective passage 35 communicating with the base of a single glue storage chamber 36, and the supply is controlled by valve means comprising a valve slide 37, which is slidable in a bore in the housing 31 and which has two annular grooves 38 and lands 39 arranged at spacings corresponding to the spacing of the nozzles. The function of the valve slide 37 is the same as that of the valve slide 14 of the applicator 10, and the valve slide 37 is provided with two collars 40 and 41 defining the positions of the valve slide for the open and closed states of the nozzles 32 in the manner of the collars 17 and 18 in the applicator 10.

The housing 31 is further provided with a heating element (not shown), a removable cover 42 and a stub pipe 43 respectively corresponding to the heating element 20, cover 21 and pipe 23 of the applicator 10, the cover 42 and pipe 43 incorporating a duct (not shown) for the introduction of compressed air into the chamber 36. Each of the nozzles 32 is associated with a respective recess 44 and rim portion (not shown), which respectively correspond to the recess 28 and rim portion 29 of the applicator 10.

The applicator 30 is operated in the same manner as the applicator 10, the joint control of the nozzles 32 by the single valve slide 37 enabling simultaneous application to the article 33 of two parallel glue strips of identical length and continuity.

Figure 4:
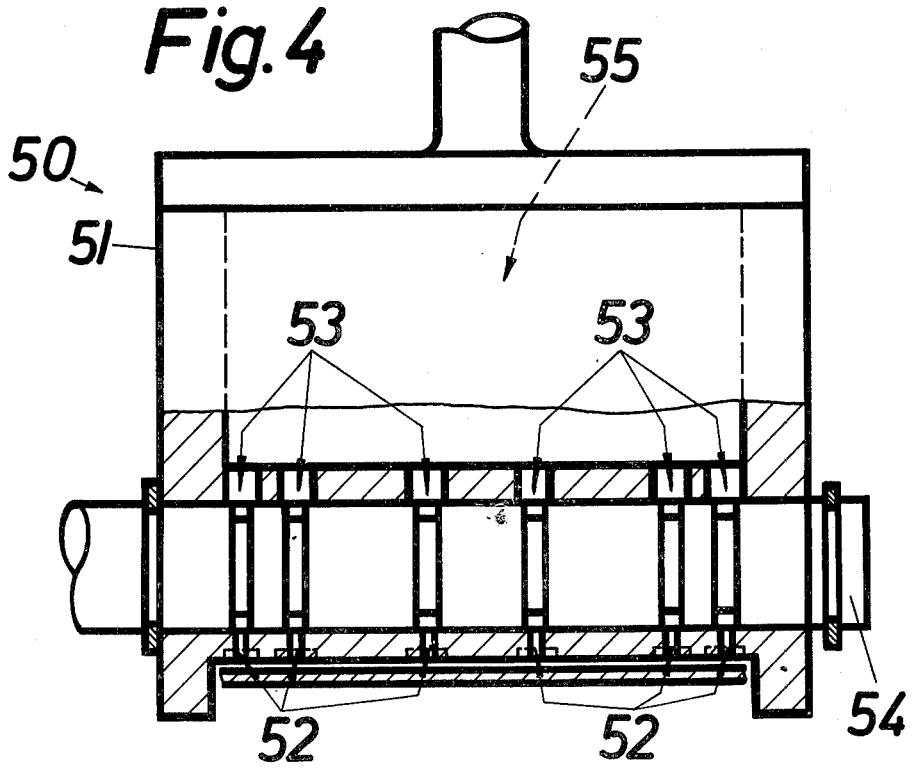
FIG. 4 is a partly sectioned side view of a glue applicator according to a third embodiment of the invention, the applicator having six nozzles controlled by a single valve.

A further variation of a multi-nozzle applicator is illustrated in FIG. 4, which shows an applicator 50 comprising a housing 51 provided with six nozzles 52 each supplied with glue from a respective one of six passages 53 and each opened and closed by a respective annular groove and land of a common valve slide 54, the passage 53 communicating with a single glue storage chamber 55. In all other functional respects, the applicator 50 is the same as the applicator 30, and the six nozzles 52 enable the simultaneous application to an article 56 moved below the nozzles of six parallel glue strips of identical length and continuity.

Figure 5:
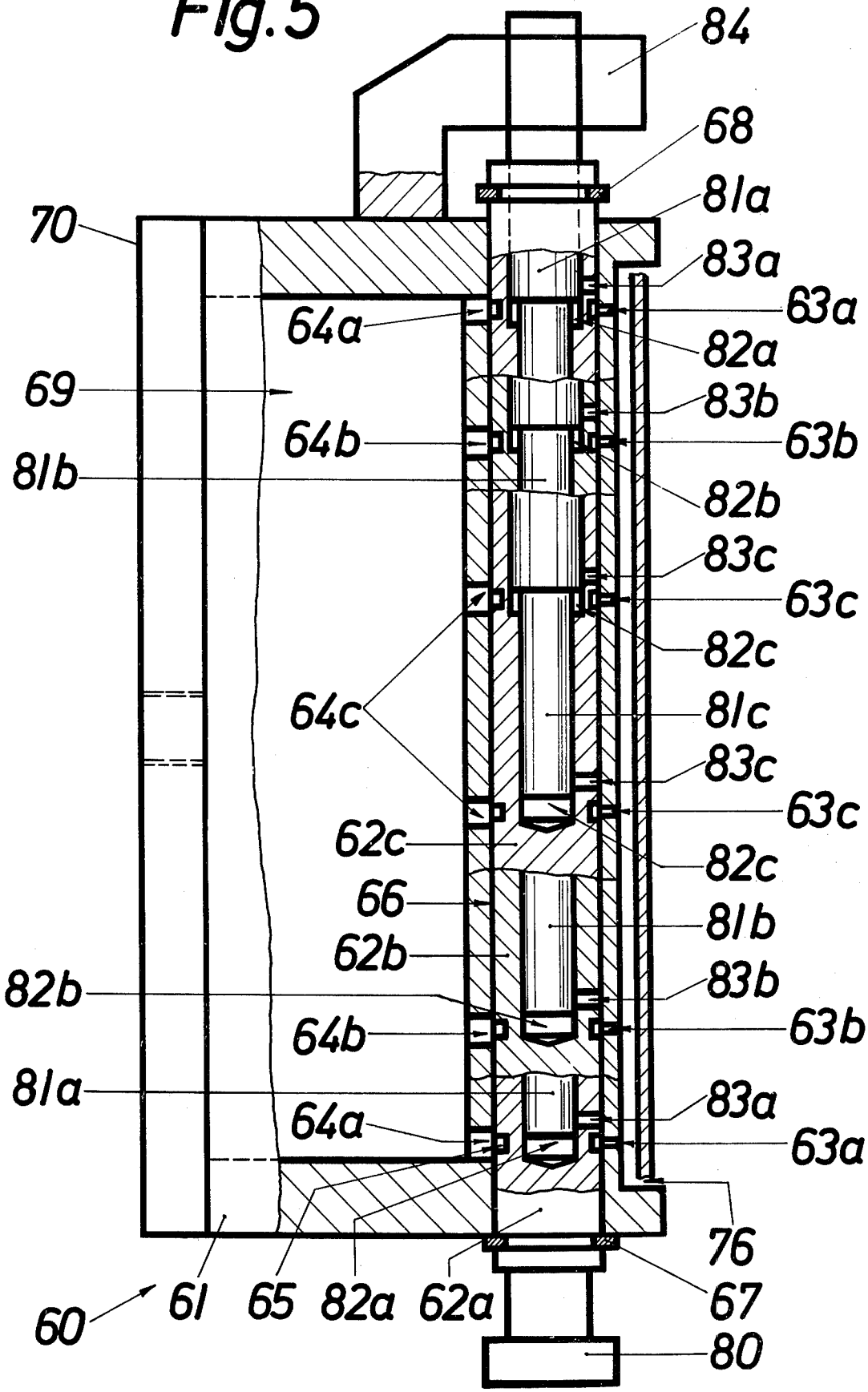
FIG. 5 is a sectional side view, on the line A—A of FIG. 7, of a glue applicator according to a fourth embodiment of the invention, the applicator having three pairs of nozzles — which are shown in communication with glue supply passages of the applicator — and a respective valve controlling each nozzle pair.
Figure 6:
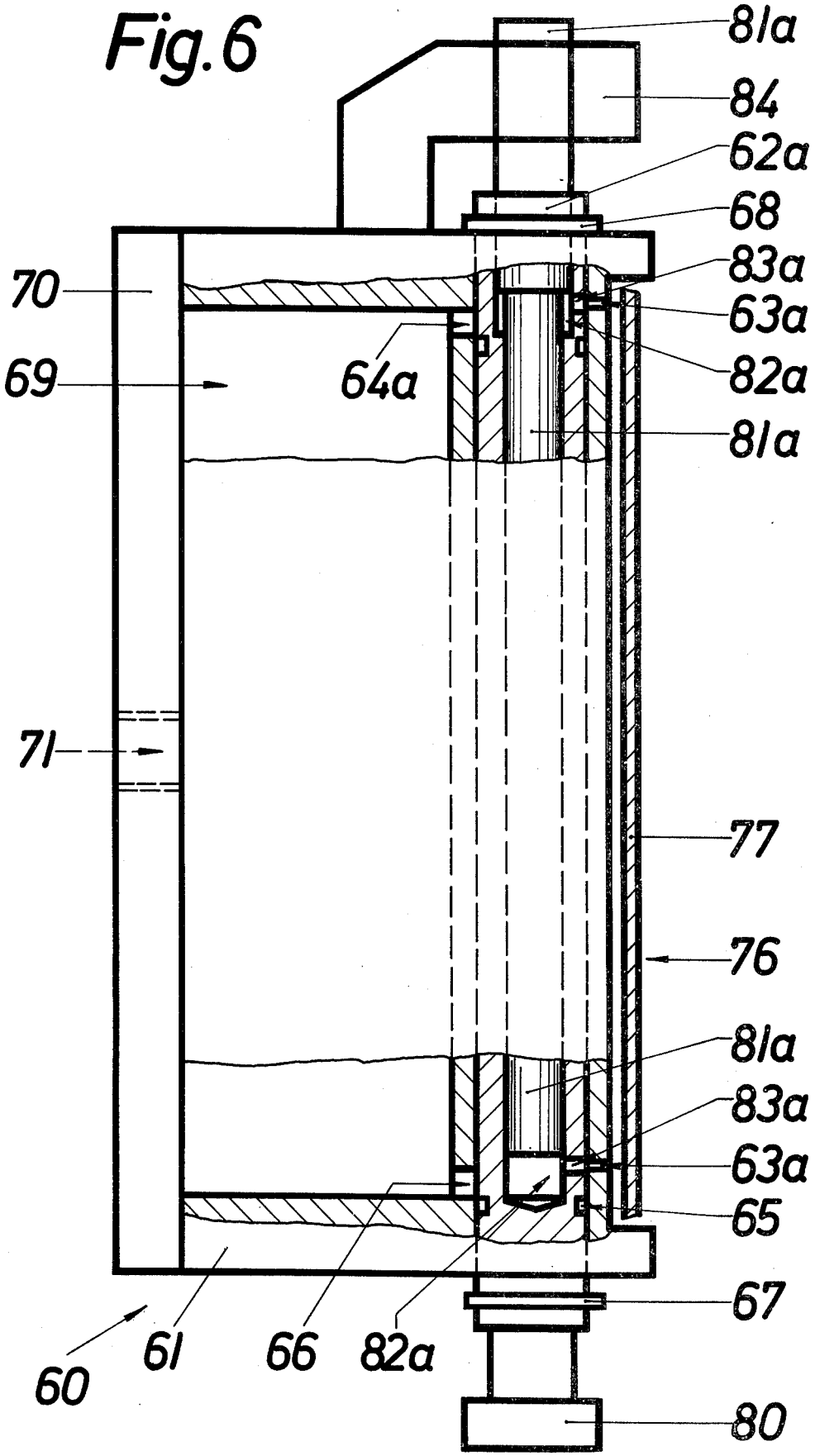
FIG. 6 is a partly sectioned side view similar to FIG. 5, but showing the nozzles of one of the nozzle pairs in communication with suction means of the applicator.
Figure 7:
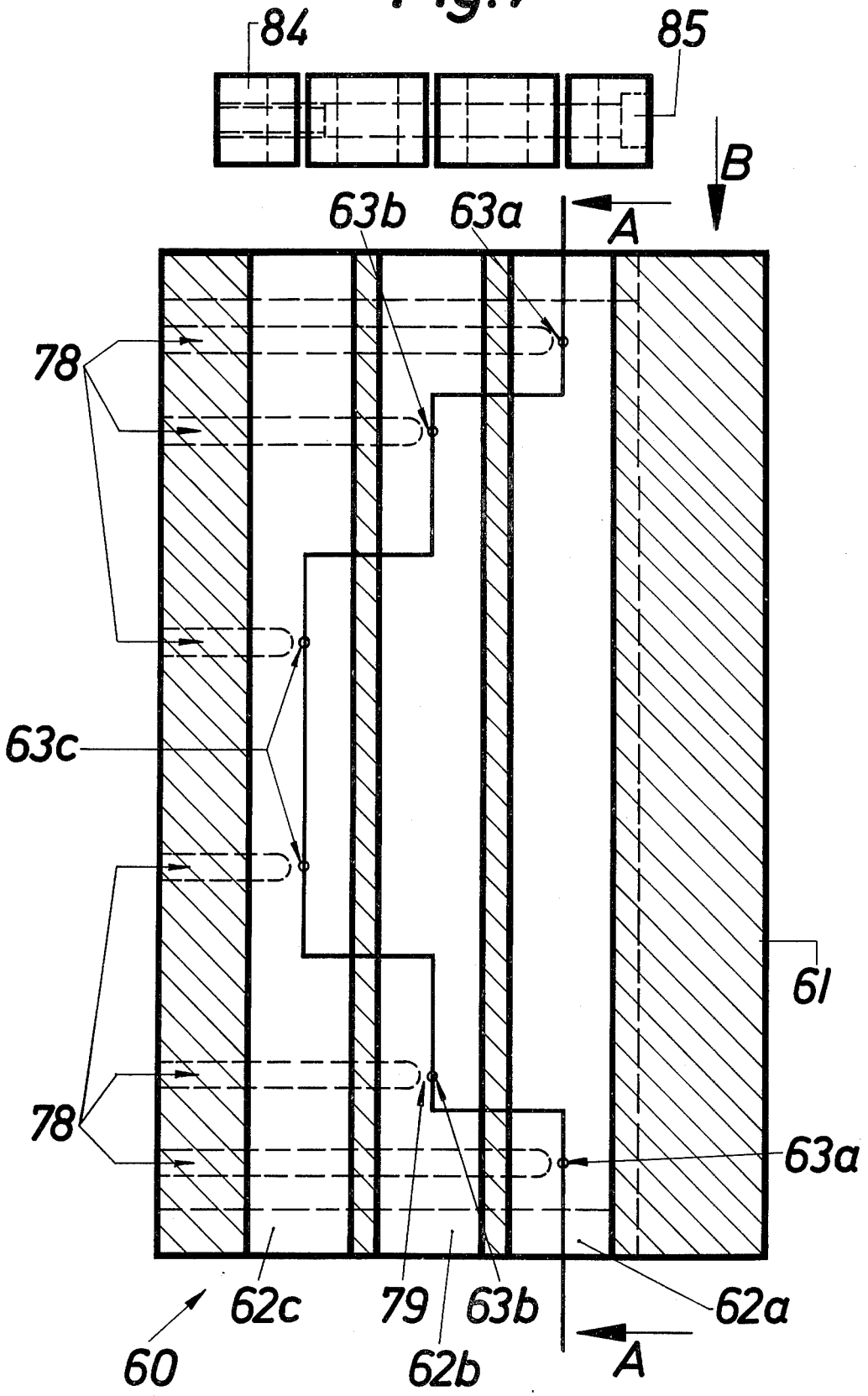
FIG. 7 is a sectional plan view of the applicator of FIG. 5.

In FIGS. 5 to 8 there is shown an applicator 60 which permits the application to an article of a maximum of three pairs of parallel glue strips, any pair of which can, however, be interrupted or discontinued independently of the other pairs. The applicator 60 comprises a housing 61 provided with three valve slides 62*a*, 62*b* and 62*c* slidable in three parallel bores arranged in the housing in a common plane, and with a first pair of applicator nozzles 63*a* controlled by the valve slide 62*a*, a second pair of nozzles 63*b* controlled by the valve slide 62*b*, and a third pair of nozzles 63*c* controlled by the valve slide 62*c*. As shown in FIGS. 5 and 7, the nozzles of each pair are arranged substantially symmetrically of a common transverse plane of the three valve slides, with the nozzles 63*a* being more widely spaced apart than the nozzles 63*b*, and the nozzles 63*b* in turn being more widely spaced apart than the nozzles 63*c*. In addition, the spacings are selected so that adjacent ones of the nozzles 63*c* and 63*b* are more widely spaced than adjacent ones of the nozzles 63*b* and 63*a*, such spacings being selected to enable the nozzles to provide a predetermined pattern of glue strips as will be subsequently explained with reference to FIG. 9.

The housing 61 further comprises a first pair of passages 64*a* to supply glue to the pair of nozzles 63*a*, and second and third pairs of passages 64*b* and 64*c* to similarly supply the pairs of nozzles 63*b* and 63*c*. In order to control the supply of glue from the passages, each of the valve slides 62*a*, 62*b* and 62*c* is provided with a respective annular groove 65 and land 66 for each of the nozzles with which it is associated, the annular grooves and lands opening and closing the nozzles to the passages under slidable movement of the valve slides in similar manner to the valve slides in the applicators 10, 30 and 50.

In addition, each of the valve slides 62*a*, 62*b* and 62*c* is provided with a pair of collars 67 and 68 having the same function as the collars 17 and 18 in the applicator 10.

Figure 8:
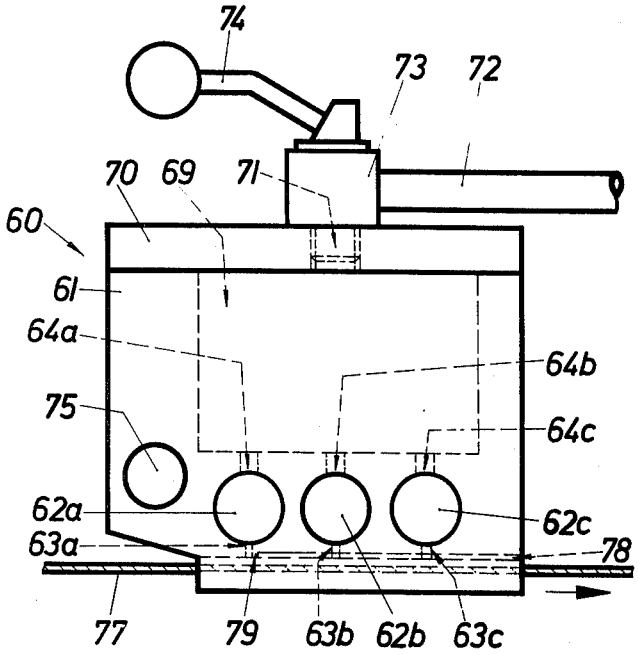
FIG. 8 is an end view of the applicator of FIG. 5, in the direction of arrow B in FIG. 7.

The passages 64*a*, 64*b* and 64*c*, which are co-axial with the respectively associated nozzles, communicate with a common glue storage chamber 69, which is closed by a removable cover 70 formed with a duct 71 for introduction into the chamber of compressed air to pressure feed glue from the chamber into the passage 64*a*, 64*b* and 64*c*. As shown in FIG. 8, the duct 71 communicates with an air line 72 via a valve block 73 arranged on the upper surface of the cover 70, the valve in the valve block 73 being operable by means of a lever 74. Also shown in FIG. 8 is a heating element 75 for heating the glue in the applicator.

Below the nozzles 63*a*, 63*b* and 63*c*, the housing 61 is provided with a guide passage 76 to guide movement past the nozzles, in the direction indicated by the arrow in FIG. 8, of an article 77 to receive strips of glue from the nozzles. The housing is also provided in the guide passage with six drying recesses 78, which are each associated with a respective one of the nozzles and separated from the associated nozzle by a respective rim portion 79, the arrangement of the recesses being shown in more detail in FIG. 7.

Each of the valve slides 62*a*, 62*b* and 62*c* is provided with a respective head 80 for the connection of individual actuating means, whereby each of the valve slides is actuable independently of the other two valve slides so that any one of the pairs of nozzles 63*a*, 63*b* and 63*c* can be opened or closed independently of the other nozzle pairs for corresponding variation in the length or continuity of the glue strips applied by that nozzle pair as compared to the strips applied by the other nozzle pairs. In operation of the applicator, therefore, the nozzles can be controlled so that at any one time glue strips can be applied by all of the nozzles, by any one of the nozzle pairs, or by a combination of any two of the nozzle pairs, or else all of the nozzles can be closed simultaneously.

As will be apparent, the applicator 60 constitutes only one example of numerous possible combinations of nozzles and valve slides, the number of valve slides, the number of nozzles controlled by the valve slides, and the relative spacings of the nozzles and of the valve slides, inter alia, being suitably adjusted to suit a desired pattern of glue strips to be applied to an article or series of articles.

The applicator 60 incorporates a further refinement designed to ensure that the glue flow from the nozzles is completely terminated when the nozzles are closed by the valve slides, for which purpose the valve slides include suction means to suck any residual glue back up the nozzles. To provide such suction, the valve slide 62*a* is formed with a blind axial bore, which extends from the end of the valve slide remote from the head 80 to a point adjacent the annular groove 65 closest to the head 80 and which is inwardly stepped by an annular face at a point adjacent the other annular groove 65. Extending into the axial bore in the valve slide 62*a* is a correspondingly stepped shaft 81*a*, which is rigidly secured to the housing and which is so arranged in the bore that when the associated nozzles 63*a* are open to the passages 64*a* as shown in FIG. 5, the face at the closed end of the bore and the adjacent axial end face of the shaft 81*a* define two opposite sides of a first cavity 82*a*, while the annular face at the step of the bore and the face at the step of the shaft define two opposite sides of a second such cavity, the arrangement being such that movement of the valve slide to close the nozzles to the passages moves the cavity-defining faces of the valve slide away from the cavity-defining faces of the stationary shaft so as to increase the volume of the cavities. Conversely, on slidable movement of the valve slide to open the nozzles to the passages, the cavity-defining faces of the valve slide are moved towards the cavity-defining faces of the shaft, so as to decrease the volumes of the cavities.

In addition, the valve slide 62*a* is provided with two radially extending channels 83*a*, which are each so connected to the axial bore in the valve slide and spaced from a respective one of the annular grooves 65 — by an amount corresponding to the travel of the valve slide between its two positions — as to communicate with an adjacent one of the cavities 82*a* and an adjacent one of the nozzles 63*a* when the valve slide is displaced to close the nozzles to the passages 64*a*. Conversely, when the valve slide is displaced to open the nozzles to the passages, the channels 83*a* are each closed at one end thereof by a surface portion of the shaft 81*a* and at the other thereof by a surface portion of the housing bore containing the valve slide 62*a*.

As shown in FIG. 5, the valve slides 62*b* and 62*c* are formed with similar stepped bores receiving similar shafts 81*b* and 81*c*, respectively, to define similar cavity pairs 82*b* and 82*c*. In addition, the valve slides 62*b* and 62*c* are provided with two channel pairs 83*b* and 83*c*, respectively, which are communicable with the cavity pairs 82*b* and 82*c* and nozzles 63*b* and 63*c* in the same manner as described for the channels 62*a*.

The shafts 81*a*, 81*b* and 81*c* are secured to the housing 61 by a bracket 84, which is provided with three slotted bores in which the shafts are clamped by means of a bolt 85. By releasing the clamping pressure applied by the bolt 84, individual ones of the shafts can be adjusted relative to the housing 61 and slides 62*a*, 62*b* and 62*c*, so as to correspondingly adjust the volumes of the cavities 82*a*, 82*b* and 82*c*.

The application of the suction effect provided by the volume enlargement of the cavities 82*a*, 82*b* and 82*c* can be appreciated by reference to FIGS. 5 and 6, which show the nozzles respectively open to and closed to the glue supply passages. On movement of any one of the valve slides 62*a*, 62*b* and 62*c* from the position shown in FIG. 5 — in which the respective radial channels are completely closed — to the position shown in FIG. 6, the volumes of the cavities associated with that slide are increased and the associated channels are brought into communication with the cavities and with the associated nozzles. The vacuum created in the cavities by their volume enlargement is applied through the channels to suck from the nozzles any glue remaining therein, so as to prevent such glue from dripping onto the article 77. Conversely, when any one of the valve slides is restored to the position in which it opens the associated nozzles to the passages, the volumes of the cavities are so decreased as to create a pressure urging any glue in the channels back into the associated nozzles, the channels again being completely closed when the valve slide has reached the position shown in FIG. 5.

The provision of channels and cavities of variable volume in the valve slides hereinbefore described enables a suction action to be derived from the movement of the valve slides themselves, but if so desired an independent source of suction may be provided and may be applied to the nozzles via ducts in the valve slide similar to the channels and bores.

Figure 9:
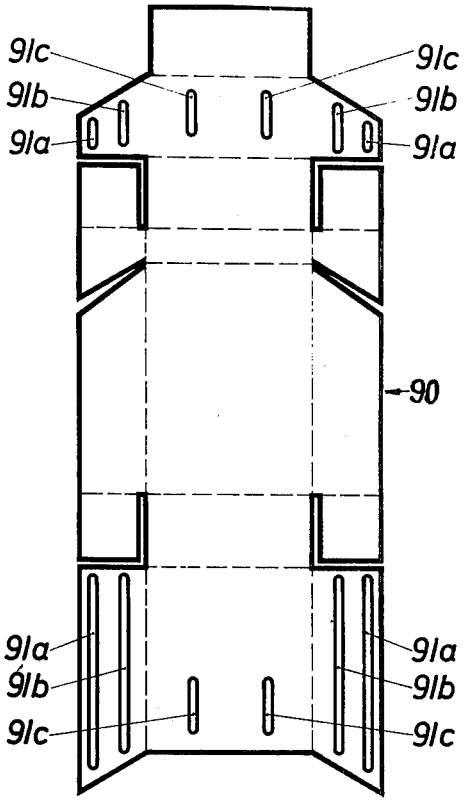
FIG. 9 is a plan view of a cardboard blank showing a pattern of glue strips applied thereto by the applicator of FIGS. 5 to 8.

In FIG. 9, there is shown a cardboard carbon blank 90, for example to form a cigarette carton, having applied thereto a pattern of glue strip pairs 91*a*, 91*b* and 91*c* produced by the nozzle pairs 63*a*, 63*b* and 63*c*, respectively, of the applicator 60. As can be seen in FIG. 9, the glue strip pairs are applied to two separate sections of the blank 90 and are of different lengths in each section, the variation in the lengths of the strip pairs being achieved by independent actuation of the valve slides 62*a*, 62*b* and 62*c* of the applicator.

Figure 10:
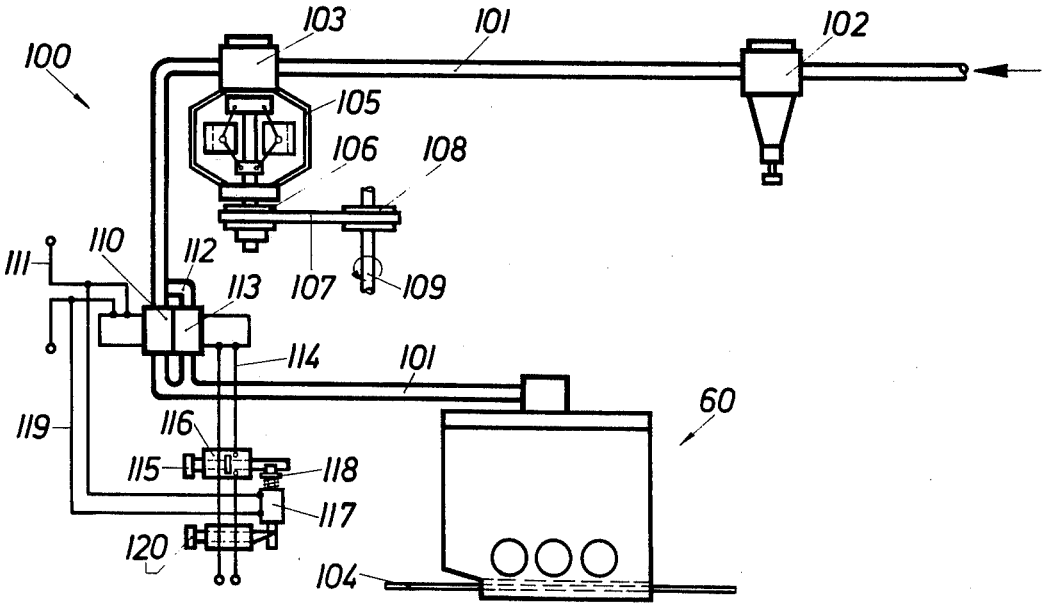
FIG. 10 is a schematic diagram of a pressure medium control system in gluing equipment incorporating the applicator of FIGS. 5 to 8.

Referring now to FIG. 10, there is shown a compressed air control system 100 in gluing equipment incorporating the applicator 60, the compressed air being employed as a pressure medium to pressure feed glue to the nozzles of the applicator.

The control system 100 comprises a pipe 101, which is connectable to a source of compressed air and which communicates with the glue storage chamber (not shown in FIG. 10) of the applicator via the air line 72 and duct 71 shown in FIG. 8. The pipe 101 incorporates a manually operable flow regulating valve 102 and, downstream of the valve 102, a further flow regulating valve 103 adapted to regulate the flow of compressed air through the pipe 101 in dependence on the operating speed of the equipment, for example the speed of movement of an article 104 past the nozzles of the applicator 60 towards means for further processing such articles, such as means for assembling articles in the form of blanks 90 into cartons.

The valve 103 is actuated by a centrifugal control mechanism 105 having a pulley 106 driven, via a drive belt 107, by a pulley 108 attached to a drive shaft 109 of a drive determining the operating speed of the equipment, an increase or decrease in the rate of rotation of the drive shaft causing the valve to be actuated by the centrifugal control mechanism to permit, respectively, an increase or decrease in the rate of flow of compressed air through the pipe 101. This ensures that the thickness of glue strips applied by the applicator 60 will remain substantially constant during variation of the operating speed of the equipment.

Downstream of the valve 103, the pipe 101 is provided with an electromagnetic control valve 110 actuable to open or close the pipe 101 on, respectively, starting or stopping of the drive for the equipment. Current to actuate the valve 110 is supplied by means of a circuit 111, which is connected to a control circuit of the drive.

The control system also comprises a bypass pipe 112, which is connected to the pipe 101 to bypass the valve 110 and which incorporates an electromagnetic bypass valve 113 actuable to open or close the pipe 112, the pipe 112 normally being closed by the valve. Current to actuate the valve 113 to open the pipe 112 is supplied by means of a circuit 114, which is completed by means of slidable movement, to the right in FIG. 10, of a manually operable contact member 115 of a switch 116. To automatically lock the contact member 115 in a position in which it completes the circuit 114, the control system includes a solenoid 117 having a resiliently urged plunger 118 adapted to engage the contact member 115 and to hold the contact member in said position.

Thus, when the drive to the equipment has been stopped and, as a consequence, the pipe 101 closed by the valve 110, the bypass valve 113 may be opened to restore the supply of compressed air to the applicator 60, so that the equipment can be operated by alternative means, for example by hand.

To ensure that the bypass valve 113 does not interfere with the control provided by the valve 110 during normal driving of the equipment, the solenoid 117 is actuated, by current supplied by a circuit 119 conneted to the circuit 111, to withdraw the plunger 118 from engagement with the contact member 115 when the drive for the equipment is started, whereupon the contact member is automatically moved to the left in FIG. 10 to break the circuit 114 and thereby cause the valve 113 to close the pipe 112.

In addition, the control system is provided with a slidable locking member 120 which, on movement towards the right in FIG. 10, is so engageable with an extension of the plunger 118 of the solenoid as to lock the plunger in a position in which it is prevented from engaging the contact member 115, whereby automatic locking of the contact member in the position in which it completes the circuit 114 is prevented.

If so desired, further locking means can be provided for locking the contact member 115 and locking member 120 in each of their respective positions.

In FIGS. 11 to 14, there is shown a gluing apparatus 130, which comprises an applicator 131 having a lower housing part 132 provided with an arrangement of three valve slides 133, three pairs of nozzles 134, and three pairs of glue supply passages 135, substantially as described in connection with the applicator 60 of FIGS. 5 to 8. Each of the valve slides is provided with an axial bore receiving a respective stationary pin 136 to define two cavities therein of variable volume, the cavities being connectable to the associated nozzle pair via radial channels to suck up glue from the nozzles in the manner of the suction means described for the applicator 60, and each of the valve slides has a head 137 for detachable connection thereto, as will be subsequently explained, of actuating means.

In addition, the lower housing part 132 is provided with a guide passage 138 to guide movement of an article 139 past the nozzles.

The lower housing part 132 is detachably mounted on an upper housing part 140 by means of two clamping members 141 (FIG. 13), which are detachably mounted on the upper housing part 140 and which are so engaged in two recesses formed in two opposite walls, respectively, of the lower housing part 132 as to clamp this part to the upper housing part. One of the clamping members 141 is mounted on the upper housing part by a bolt 142, which can be unscrewed by means of a handle 143 to relieve the clamping pressure applied by the clamping members so that — after disconnection of the valve slides from the actuating means — the lower housing part complete with the valve slides can be removed from the upper housing part for cleaning or exchange.

The upper housing part 140 is provided with a glue storage chamber 144 having a plurality of outlets 145 in its base, and with a rotary valve 146 arranged between the outlets 145 and the glue supply passages 135 of the applicator 131. The valve 146 has an axial bore and a plurality of passages so radially extending from the bore as to communicate, in the position of the valve shown in FIG. 13, with individual ones of the outlets 145 and supply passages 135. The valve 146 can be rotated by means of a handle 147 to close all of the outlets 145, so that the lower housing part can be removed from the upper housing part without loss of glue through the outlets.

For the supply of glue to the glue storage chamber 144, the upper housing part 140 is provided with an inlet 148, which communicates with a removable filtering pipe 149 from which glue fed to the inlet may flow into the chamber. The filtering pipe is retained in the upper housing part 140 by a cover plate 150, which can be removed to enable cleaning or exchange of the pipe. The chamber itself is closed by a lid 151, while a window 152, which is secured by a frame 153, is provided on one side of the upper housing part 140 to enable the condition of the filtering pipe 149 to be checked and the flow of glue into the chamber 144 to be monitored.

Figure 13:
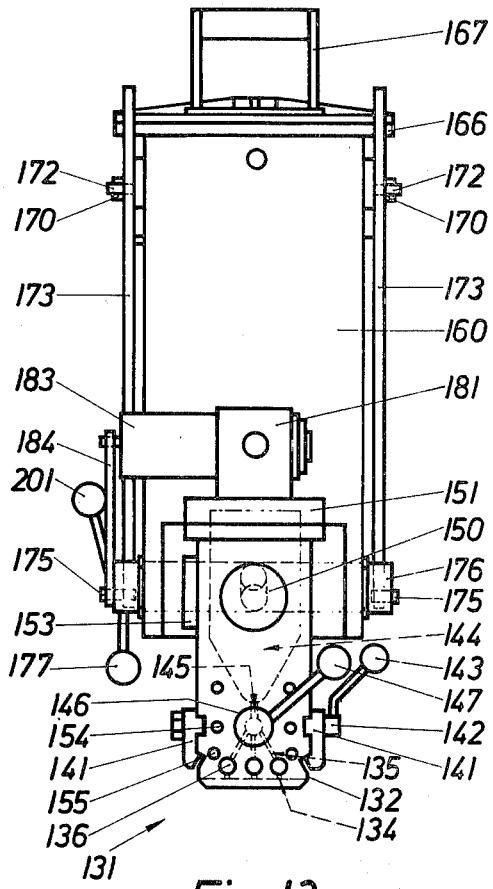
FIG. 13 is an end view, in the direction of arrow D in FIG. 11, of the upper portion of the apparatus of FIG. 11.
Figure 14:
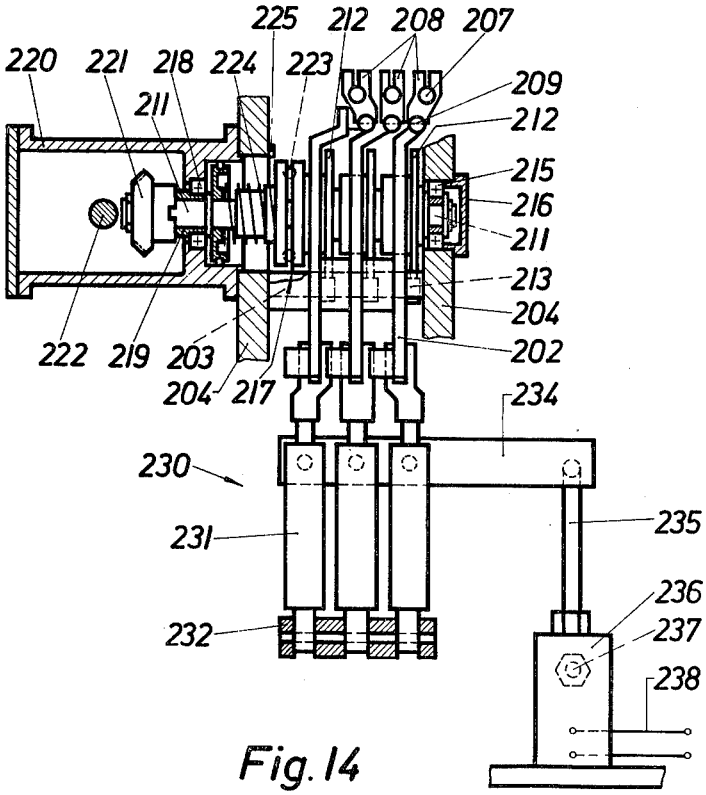
FIG. 14 is a sectional view, on the line E—E of FIG. 11, of the lower half of the apparatus of FIG. 11.

For heating of glue in the upper housing part 140 and the lower housing part 132, as shown in FIG. 13, two pairs of electric heating elements 154 are arranged in the former and a similar pair of elements 155 are arranged in the latter.

The upper housing part 140 is mounted on the lower end portion of a tank 160, which is provided with a glue reservoir 161 having at its base an outlet 162 communicating, via a rotary valve 176, with the inlet 148 of the chamber 144, the valve 176 being rotatable by a handle 177 to prevent the passage of glue from the reservoir to the chamber. Arranged in the reservoir 161 are three electric heating elements 163 for heating glue in the reservoir, the elements 163 being of larger capacity than the elements 154 and 155 in the applicator housing parts. To enable the contents of the reservoir to be viewed, the tank 160 is provided with a viewing window 164, which is secured in position by a frame 165.

The reservoir 161 is closed at its upper end by an openable lid 166, which is provided with a handle 167 and with two angled lugs 168 each pivotably mounted by a pin 169 on a bracket attached to the tank 160. To retain the lid in a closed position, there are provided locking means in the form of two locking bars 170, which are arranged one on each of two opposite sides of the tank and which are each pivotably mounted at one end thereof on the lower end of a respective one of the angled lugs 168. Each of locking bars is guided adjacent its other end between two pins 161 attached to the associated side of the tank, so that under upward pivoting of the lid 166 about the pins 169, the locking bars are displaced towards the right in FIG. 11. To prevent such displacement and thereby to retain the lid in its closed position, each of the locking bars abuts at said other end thereof a peg 172 carried by a respective closure arm 173, the closure arms also being arranged one on each of said two sides of the tank. Each of the closure arms is guided between a respective pair of pins 174 secured to the tank, and at its lower end is eccentrically connected by a pin 175 to a respective one of the ends of the rotary valve 176. Under rotation of the valve 176, in a clockwise direction from the position shown in FIG. 11, to close the reservoir outlet 162, the closure arms 173 are lifted until the pegs 172 are clear of the locking bars 170, so as to allow the necessary displacement of the locking bars to permit the lid 166 to be opened.

Each of the closure arms 173 is provided at its upper end with a catch 178 engageable with a respective abutment 179 on the lid 166 to provide a positive lock for the lid in its closed position, the catches being released from the abutments on upward movement of the closure arms as described in the preceding paragraph.

To enable pressure feeding of glue to the applicator nozzles 134, the reservoir 161 is provided at the upper end of the tank with an inlet connected to a pipe 180 for supplying compressed air to the reservoir, the pipe 180 being connected, via a valve block 181 mounted on the upper surface of the lid 151, to a pipe 182 communicating with a source of compressed air. If so desired, the apparatus 130 may include the control system 100, in which case the pipe 182 may constitute the downstream end portion of the pipe 101 shown in FIG. 10.

Figure 11:
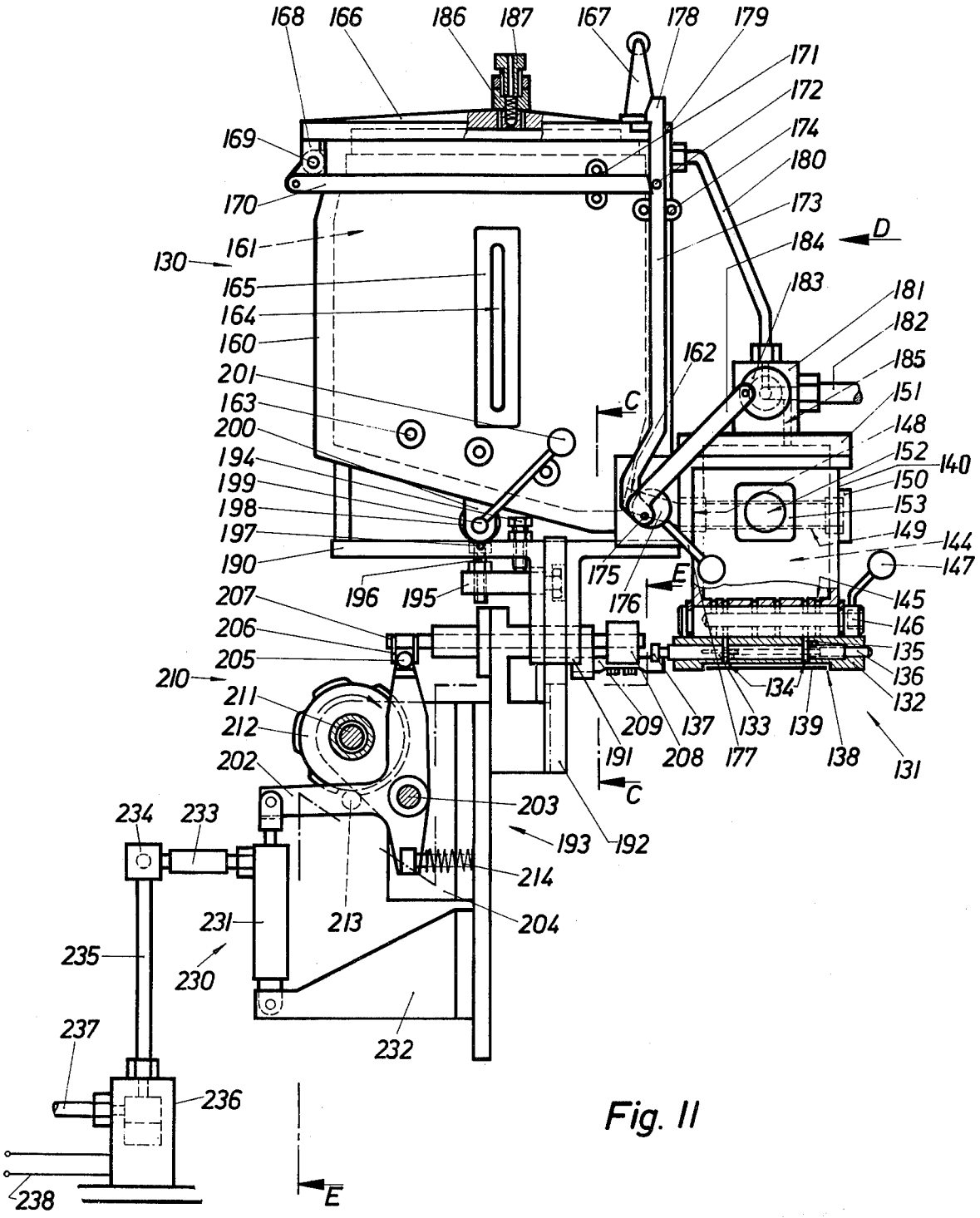
FIG. 11 is a partly sectioned side view of gluing apparatus embodying a glue applicator according to a fifth embodiment of the invention, the applicator having an arrangement of nozzles and valves similar to that of the applicator of FIGS. 5 to 8.
Figure 12:
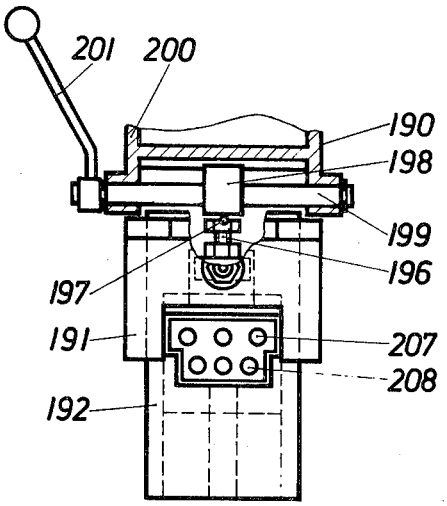
FIG. 12 is a sectional view, on the line C—C of FIG. 11, of the central region of the apparatus of FIG. 11.

The valve block 181 incorporates a rotary valve 183 which is rotatable, in a clockwise direction in FIG. 11, to shut off the supply of compressed air to the pipe 180. To ensure that such supply is automatically discontinued when the lid 166 of the reservoir 161 is opened, a link 184 is eccentrically connected at one end thereof to the rotary valve 183 and at its other end to one of the pins 175 of the rotary valve 176, so that on rotation of the valve 176 by the handle 177 to unlock the lid 166 and close the outlet 162, the valve 183 is correspondingly rotated to shut off the compressed air supply. The lid 166 can then be opened without undesired discharge into the atmosphere of compressed air from the supply source.

The handle 177 thus combines the interrelated functions of controlling the glue discharge from the reservoir 161, the supply of compressed air to the reservoir, and the locking of the lid 166 of the reservoir.

Conversely, to enable an uninterrupted supply of compressed air to the storage chamber 144 so as to maintain pressure therein, the valve block 181 and lid 151 are provieed with a duct 185 connected to the outlet of the pipe 182 to bypass the valve 183.

In addition, to prevent excess pressure arising in the reservoir 161 and chamber 144, the reservoir lid 166 incorporates a pressure relief valve 186, which comprises a spring-loaded ball closing an escape passage in the lid 166, and a bolt 187 to adjust the loading applied to the ball.

The tank 160, complete with the applicator 131, is carried by a frame 190, which is provided with two guide members 191 defining therebetween a passage in which a post 192 of a support 193 is so engaged that the frame is vertically displaceable relative to the support. The frame 190 is also provided with a bolt 194 which bears on the upper surface of a bracket 195 of the post 102 to determine the spacing of the frame from the support, the bolt being adjustable to vary such spacing.

The bracket 195 is provided at its free end with an adjustable bolt 196, the head of which is engaged, via a ball 197, by an eccentric 198 carried on a shaft 199 journalled in two lugs 200 attached to the frame 190. Connected to the shaft 199 is a handle 201, whereby the shaft and eccentric can be rotated from the position shown in FIGS. 11 and 12 to displace the frame upwardly from the support 193 so as to enable the valve slides 133 of the applicator 131 to be uncoupled from actuating means arranged on the support.

The eccentric 198 is provided on its circumference with two diametrically opposite detents engageable with the ball 197 to locate the frame 190 in its raised and lowered positions.

To actuate the three valve slides 133 of the applicator 131, the apparatus 130 is provided with drive means enabling the valve slides to be independently actuated in cycles for continuous application of glue strips to a succession of articles moved through the guide passage 138 of the applicator, and with drive means enabling actuation of the valve slides to close all of the nozzles 134 — in particular when operation of the apparatus is discontinued — regardless of the valve slide position determined by the cyclic drive.

For this purpose, arranged on the support 193 are three bell crank levers 202, which are pivotable about a common shaft 203 extending between two parallel wall elements 204 of the support and which are each provided at the free end of an upwardly extending arm thereof with a respective roller 205. Each of the rollers 205 is located between a pair of entraining members 206 provided at one end of a respective one of three recriprocatable rods 207, the rods being slidably engaged in corresponding bores in a sleeve, which is attached to the support 193 and which extends through the post 192 and through recesses in the guide members 191 of the frame 190. Each of the rods 207 is clamped at its other end in a respective connector 208, to which a respective drive pin 209 is secured by means of screws. Each of the drive pins 209 is provided at one end thereof and in its upper surface with a groove receiving the head 137 of a respective one of the valve slides 133, and is slidably engaged at its other end in a bore provided in a downwardly directed extension of the sleeve.

As will be apparent from the foregoing description, under pivotal movement of the bell crank levers 202, the rods 207 and drive pins 209 are correspondingly axially displaced to so move the valve slides 133 of the applicator 131 as to open or close the nozzles 134. The mode of coupling of the valve slides to the drive means by reception of the valve slide heads 137 in the grooves in the upper surfaces of the drive pins 209 allows the valve slides to be uncoupled in a simple manner by lifting the frame 190, which carries the tank 160 and applicator 131, until the heads 137 are disengaged from the grooves. The clamping members 141 clamping lower housing part 132 of the applicator to the upper housing part 140 can then be released so that the former can be removed.

To pivot the levers 202 so as to operate the valve slides independently of each other and in a cyclic manner, there is provided a cam drive 210, comprising a two part driven shaft 211 having rigidly mounted on one part thereof three wheel cams 212, which have respectively different profiles and which are each arranged between the wall elements 204 to act on a respective roller 213 mounted on a generally horizontally extending arm of a respective one of the levers 202. As shown in FIG. 11, each of the cams 212 has a series of valleys and lobes to provide a corresponding sequence of actuations of the associated one of the valve slides 133 in each revolution of the shaft 211, the valve slides thus being actuated at various times during each such revolution to produce, for example, a glue strip pattern of the kind illustrated in FIG. 9. Each of the levers 202 is additionally provided with a spring 214, which is arranged between the support 193 and a downwardly directed arm of the lever and which acts on the lever to urge its roller 213 into engagement with the respective one of the cams 212.

The said one part of the shaft 211 is rotatably mounted at one end thereof in one of the wall elements 204 by means of a bearing 215 located in an aperture in that wall element, the aperture being closed by a cover 216, and is provided at its other end with one half of a drive coupling 217. The other half of the drive coupling 217 is slidably mounted on one end of the other part of the shaft 211, said other part being rotatably mounted by means of a bearing 218 and a sleeve 219 in a stepped bore in a gear casing 220 secured to the other one of the wall elements 204, and being provided at its other end with a bevel gear 221 meshing with a bevel gear (not shown) carried by a drive shaft 222 of the apparatus. One of the coupling halves of the coupling 217 is provided, in its face adjacent the other coupling half, with a plurality of balls 223, which are so engageable in a corresponding plurality of recesses provided in the adjacent face of the other coupling half as to rotationally couple the two halves together, the balls being urged into the recesses by means of a spring 224 acting between the slidable coupling half and a lubricant seal mounted on said other part of the shaft 211. The balls 223 are so radially spaced from each other as to be engageable in the recesses in only one rotational relationship of the coupling halves.

By axial movement — against the loading of the spring 224 — of the slidable coupling half into the stepped bore of the gear casing 220, the coupling haves can be separated to uncouple the two parts of the shaft 211. A lock 225 is provided on said other one of the wall elements 204 to prevent undesired movement of the slidable coupling half into the bore.

To pivot the levers 202 to actuate the valve slides to close all of the nozzles simultaneously, in particular when the apparatus stops with one or more of the rollers 213 located in a valley or valleys of the cams 212, there is provided a pneumatic drive 230 comprising three pneumatic piston-cylinder units 231, the cylinders of which are pivotably mounted on a bracket 232 of the support 193 and the piston rods of which are each pivotably connected to the horizontally extending arm of a respective one of the levers 202. Compressed air to actuate the piston-cylinder units, in particular to retract the pistons and piston rods into the cylinders so as to operate the levers 202 and valve slides 133 to close the nozzles 134, is supplied to the three cylinders by three flexible hoses 233, which are connected to a distributor 234 connected to a pipe 235. The pipe 235 is in turn connected, via a valve block 236, to a further pipe 237, which communicates with a source of compressed air.

The valve block 236 incorporates an electromagnetic valve, which, when operation of the apparatus is discontinued, is actuated through a circuit 238 to open the pipe 235 to the pipe 237, so as to initiate the supply of compressed air to the piston-cylinder units 231 thereby to cause the nozzles 134 to be closed. Simultaneously, the supply of compressed air to the reservoir 161 and chamber 144 is shut off, for example by the control valve 110 of the control system 100 when such system is incorporated in the apparatus.

When operation of the apparatus is recommenced, the valve of the valve block 236 is actuated by the circuit 238 to close the pipe 235 to the pipe 237, so that the piston-cylinder units are relieved of actuating pressure and the springs 214 act on the levers 202 to restore engagement of the rollers 213 with the cams 212, in particular those rollers that were located in valleys of the cams when the apparatus was stopped.

By this means, joint closure of the nozzles to prevent seepage of glue therefrom can be automatically carried out, independently of the cam drive 210, when the apparatus is stopped.

If so desired, the pneumatic drive 230 may be adapted to actuate the valve slides independently of each other as well as in unison.

It will be readily apparent that other modifications to the applicators, equipment and apparatus hereinbefore described may be carried out within the scope of the invention.

I claim:

1. A glue applicator comprising a housing provided with an applicator nozzle, with valve means, and with a passage to conduct glue to the nozzle, the valve means being interposed between the passage and the nozzle and comprising a bore in the housing, a valve slide slidable in said bore to control communication between the passage and the nozzle, the valve slide being provided with a conduit and with a closure surface so arranged that in a first position of the valve slide communication between the passage and the nozzle is provided by the conduit and in a second position of the valve slide the closure surface closes at least one of the passage and the nozzle, and surfaces defining a cavity in the valve slide, the valve slide being provided with a channel which, in said second position of the valve slide, communicates with the nozzle and said cavity, said surfaces being relatively moved, on movement of the valve slide into said second position, to so increase the volume of said cavity as to create a partial vacuum therein to suck glue from the nozzle into said channel, and being relatively moved, on movement of the valve slide into said first position, to so decrease the volume of said cavity as to create a pressure to expel glue from said channel back into the nozzle.

2. An applicator as defined in claim 1, wherein the conduit is provided by an annular groove in the valve slide, and the closure surface by a land adjacent the groove.

3. An applicator as defined in claim 1, wherein the valve slide is provided with stop means to define said first and second positions of the valve slide.

4. An applicator as defined in claim 3, wherein the valve slide extends completely through the housing, and said stop means comprises two collars arranged one at each end of the valve slide externally of the housing to abut respective surfaces of the housing in said first position and said second position of the valve slide, respectively.

5. An applicator as defined in claim 1, wherein the nozzle and the passage extend substantially radially of said bore.

6. An applicator as defined in claim 1, wherein the nozzle and the passage are co-axial.

7. An applicator as defined in claim 1, wherein the housing is provided with a chamber for the storage of glue to be supplied to the nozzle, and the passage communicates with said chamber.

8. An applicator as defined in claim 7, wherein the housing is provided with a duct for supplying said chamber with a pressure medium for the pressure feeding of glue from said chamber to the nozzle.

9. An applicator as defined in claim 1, wherein the housing is provided with heating means for heating glue contained in the applicator.

10. An applicator as defined in claim 1, wherein the housing is provided with a guide passage for the guidance of articles below the nozzle to receive strip coatings of glue therefrom.

11. An applicator as defined in claim 10, wherein the housing is provided with a recess extending away from the nozzle and above a given path of a glue strip applied by the nozzle to an article guided in said guide passage, the recess being separated from the nozzle by a rim portion thereof.

12. An applicator as defined in claim 1, wherein the valve slide is provided with an axial bore and the valve means further comprises a member, which is engaged in said axial bore to be slidable relative to the valve slide and which is attached to the housing to be stationary relative thereto, said surfaces being provided by surface portions of said member and said axial bore, and said surface portions being arranged to be moved relative to each other, under slidable movement of the valve slide, to increase or decrease the volume of said cavity according to the direction of movement of the valve slide.

13. An applicator as defined in claim 12, wherein said channel so communicates with said axial bore as to be opened by said member during movement of the valve slide into said first position and closed by said member during movement of the valve slide into said second position.

14. A glue applicator comprising a housing provided with an applicator nozzle, with valve means, and with a passage to conduct glue to the nozzle, the valve means being interposed between the passage and the nozzle and comprising a bore in the housing, a valve slide slidable in said bore to control communication between the passage and the nozzle, the applicator housing being provided with one such nozzle and slide valve or with a plurality of such nozzles and one or more such slide valves, and a control system for controlling a supply of a pressure medium to pressure feed glue to the or each nozzle, the control system comprising a conduit, which is connectable to a source of the pressure medium and which is arranged to supply the pressure medium to the applicator, a control valve, which is arranged in said conduit and which is adapted to open and close said conduit on respectively starting and stopping of a drive for the equipment, a bypass duct connected to said conduit to bypass the control valve, and a bypass valve arranged in the bypass duct and actuable to open the bypass duct when said drive is stationary.

15. Equipment as defined in claim 14, wherein the bypass valve comprises an electromagnetic valve, and the control system further comprises a manually operable switch operable to actuate said electromagnetic valve to open the bypass duct.

16. Equipment as defined in claim 15, wherein the control system further comprises locking means to automatically lock said switch in a position in which the bypass duct is maintained in an open condition by the bypass valve, the locking means being actuable to release said switch from said position on starting of said drive.

17. Equipment as defined in claim 14, wherein the control system further comprises a flow regulating valve arranged in said conduit to regulate the flow of the pressure medium in dependence on the operating speed of the equipment.

18. Equipment as defined in claim 17, wherein the flow regulating valve comprises a centrifugal valve, which is driven by said drive and which is arranged in the conduit upstream of the control valve.

19. A glue applicator comprising a housing provided with a plurality of applicator nozzles arranged at spacings to provide parallel glue strips, and with a corresponding plurality of passages respectively associated with the nozzles to conduct glue thereto, a plurality of bores in the housing, a plurality of valve slides each interposed between a respective one of the passages and at least one of the nozzles and slidable in a respective one of said bores to control the supply of glue to at least one respective one of the nozzles, and actuating means to actuate the valve slides of the applicator, said actuating means comprising first drive means to actuate the valve slides independently of each other and cyclically during operation of the apparatus, and second drive means to actuate the valve slides to close all of the nozzles of the applicator when operation of the apparatus is discontinued.

20. An applicator as defined in claim 19, wherein each of the valve slides is provided with a respective conduit and closure surface for the or each nozzle and passage associated with that valve slide.

21. An applicator as defined in claim 19, wherein the valve slides are independently actuable.

22. An applicator as defined in claim 19, wherein the housing is provided with three such valve slides and with three pairs of nozzles controlled by the valve slides, respectively.

23. An applicator as defined in claim 22, wherein the nozzles of each pair are arranged substantially symmetrically of a common transverse plane of the three valve slides, the nozzles of a first one of the pairs being more widely spaced apart than the nozzles of a second one of the pairs, and the nozzles of the second pair being more widely spaced apart than the nozzles of the third pair.

24. Apparatus as defined in claim 19, wherein said first drive means comprises a respective cam and a respective rocker for each of the valve slides, the cams being operable to actuate the valve slides through the rockers.

25. Apparatus as defined in claim 19, wherein each of the rockers is provided with a roller and the cams act on the rockers through the rollers, said first drive means further comprising resilient means acting on the rockers to maintain the rollers in engagement with the cams.

26. Apparatus as defined in claim 19, wherein the cams are rigidly mounted on a common shaft and have respectively different profiles.

27. Apparatus as defined in claim 19, wherein said second drive means comprises a respective piston-cylinder unit coupled to each of the rockers, the piston-cylinder units being jointly actuable.

28. Apparatus as defined in claim 19, wherein the applicator housing comprises an upper housing part and a lower housing part, the lower housing part being provided with the nozzles, passages and valve slides and being detachably mounted on the upper housing part.

29. Apparatus as defined in claim 28, wherein the upper housing part is provided with a pair of clamping members, which are each so engaged with a respective one of two opposite sides of the lower housing part as to clamp the lower housing part to the upper housing part.

30. Apparatus as defined in claim 29, wherein the applicator is provided with a release mechanism operable to so relieve the clamping pressure applied by the clamping members as to enable removal of the lower housing part from the upper housing part.

31. Apparatus as defined in claim 28, wherein the upper housing part is provided with a glue storage chamber having outlet means for the supply of glue from said chamber to the passages in the lower housing part.

32. Apparatus as defined in claim 31, wherein the upper housing part is provided with a valve member actuable to close the outlet means.

33. Apparatus as defined in claim 31, comprising a tank provided with a glue reservoir and with a removable lid closing the glue reservoir, the glue reservoir having an outlet communicating with said chamber.

34. Apparatus as defined in claim 33, wherein the tank is provided with a duct for the supply of a pressure medium to said reservoir to enable pressure feeding of glue from said reservoir to said chamber.

35. Apparatus as defined in claim 34, wherein the tank is provided with closure means for retaining said lid in a closed position, and the duct incorporates a valve which is so interlocked with said closure means that said lid is removable only when said duct is closed by said valve.

36. Apparatus as defined in claim 33, wherein said actuating means are coupled to the valve slides of the applicator, and the tank and applicator are displaceable relative to said actuating means to uncouple said actuating means from the valve slides.

* * * * *